United States Patent [19]

Wells

[11] Patent Number: 4,812,834

[45] Date of Patent: Mar. 14, 1989

[54] GRAPHICS DISPLAY SYSTEM WITH ARBITRARY OVERLAPPING VIEWPORTS

[75] Inventor: Charles H. Wells, Portola Valley, Calif.

[73] Assignee: Cadtrak Corporation, San Mateo, Calif.

[21] Appl. No.: 761,753

[22] Filed: Aug. 1, 1985

[51] Int. Cl.[4] ..... G09G 1/00

[52] U.S. Cl. ..... 340/721; 340/723; 340/798; 340/734

[58] Field of Search ..... 340/721, 716, 723, 724, 340/798, 799, 747, 750, 734

[56] References Cited

U.S. PATENT DOCUMENTS

| | | | |
|---|---|---|---|
| 4,204,206 | 5/1980 | Bakula et al. | 340/799 |
| 4,204,207 | 5/1980 | Bakula et al. | 340/799 |
| 4,204,208 | 5/1980 | McCarthy | 340/799 |
| 4,258,361 | 3/1981 | Hydes et al. | 340/721 |
| 4,386,410 | 5/1983 | Pandya et al. | 340/726 |
| 4,404,554 | 9/1983 | Tweedy, Jr. et al. | 340/726 |
| 4,412,294 | 10/1983 | Watts et al. | 340/726 |
| 4,533,910 | 8/1985 | Sukonick et al. | 340/798 |
| 4,542,376 | 9/1985 | Bass et al. | 340/721 |
| 4,618,858 | 10/1986 | Belch | 340/721 |

FOREIGN PATENT DOCUMENTS

| | | |
|---|---|---|
| 0120135 | 3/1984 | European Pat. Off. . |
| 0121015 | 10/1984 | European Pat. Off. . |
| 0147542 | 10/1985 | European Pat. Off. . |
| WO85/02048 | 5/1985 | PCT Int'l Appl. . |
| 2130857 | 6/1984 | United Kingdom . |

*Primary Examiner*—John W. Caldwell, Sr.
*Assistant Examiner*—Jeffery A. Brier
*Attorney, Agent, or Firm*—Spensley Horn Jubas & Lubitz

[57] ABSTRACT

In this graphics display system with arbitrary overlapping viewports, a display graphics image is assembled by acquiring from a source of image graphics data line portions of said image defined by a set of sequential control word sequences contained in a control table. Advantageously, each control word sequence includes at least one first control word defining a line portion of single viewport, and a continuation field. At least some of the control word sequences also include at least one continuation control word which defines a line portion of another independent but overlapping viewport. To produce the display, the system includes means responsive to the control words for acquiring graphics data specified therein and providing the same for use in the displayable image. If the continuation field indicates the presence in the sequence of a continuation control word, the system acquires graphics data specified by the continuation control word and utilizes the same in the displayable image thereby producing a display with overlapping viewports.

5 Claims, 5 Drawing Sheets

Fig. 4

CONTROL WORD FORMAT

Control Word #1 Viewport Constants

```
B B B
```

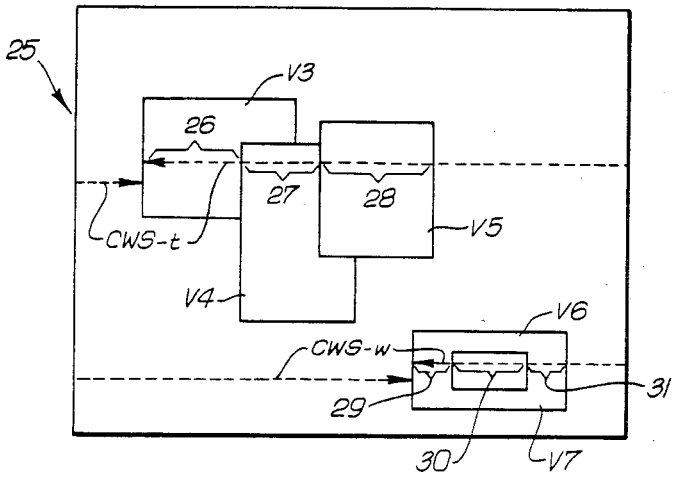
Fig. 5
Fig. 7
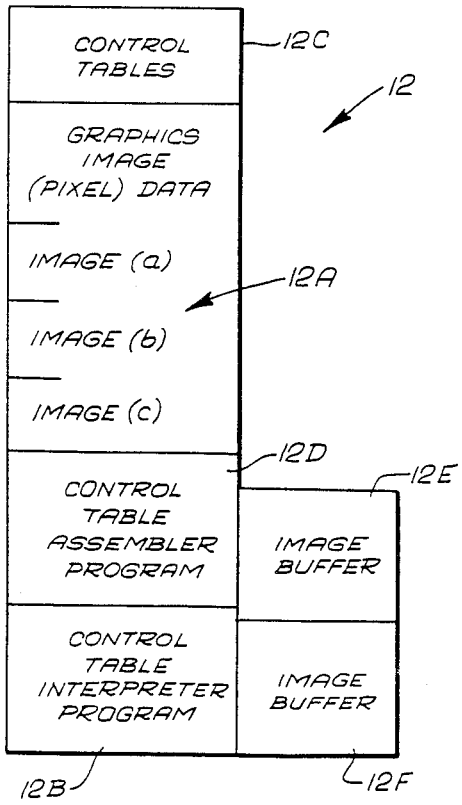
Fig. 6
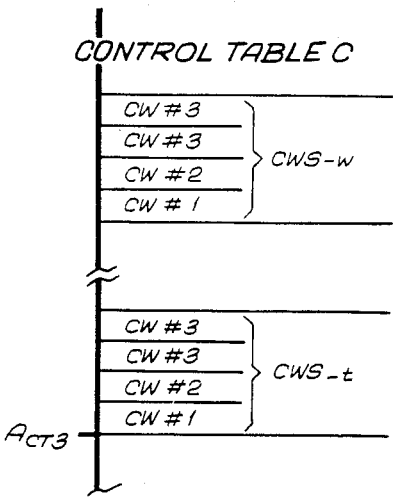

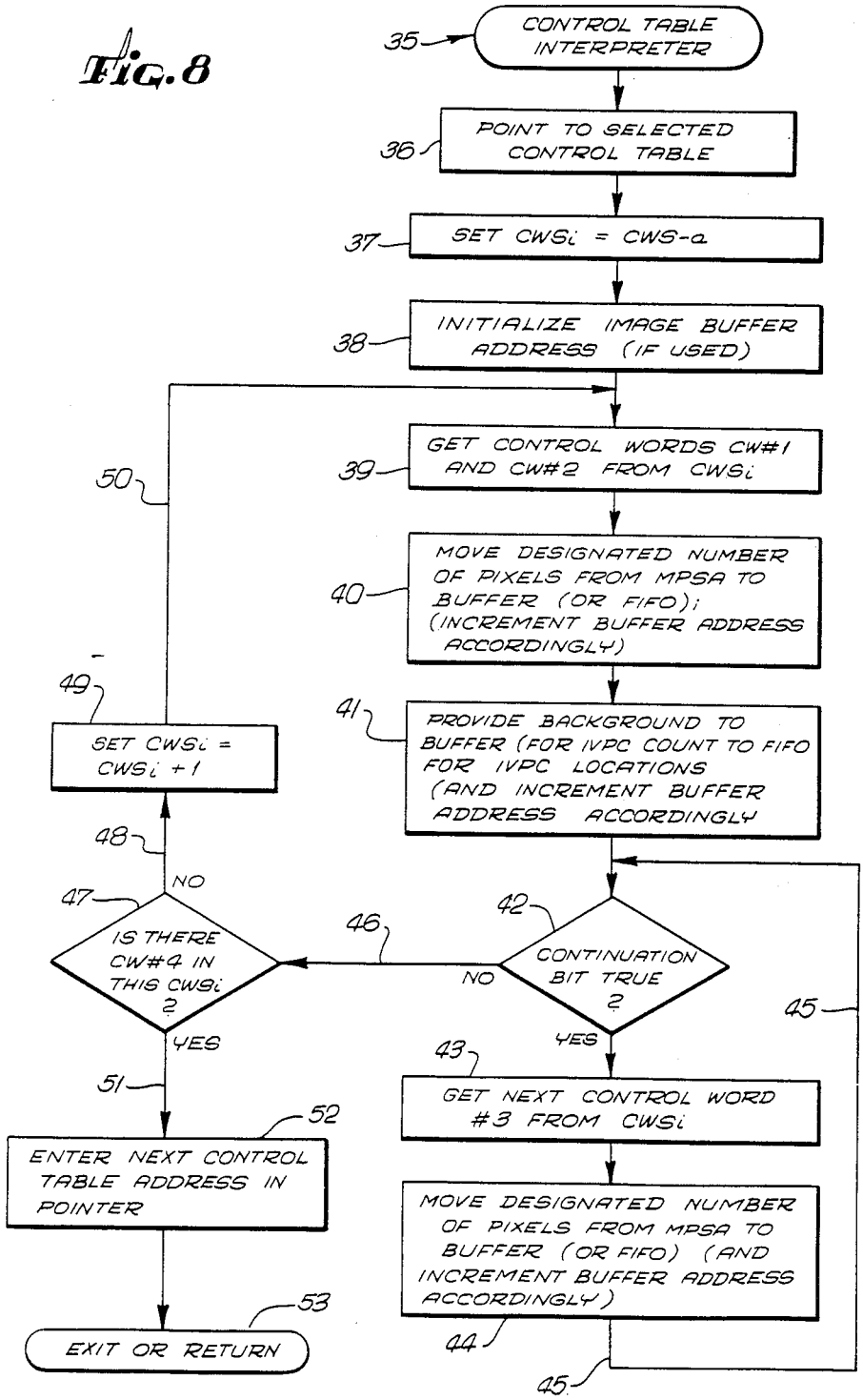
Fig. 8
35
CONTROL TABLE INTERPRETER
36
POINT TO SELECTED CONTROL TABLE
37
SET CWSi = CWS-a
38
INITIALIZE IMAGE BUFFER ADDRESS (IF USED)
39
GET CONTROL WORDS CW#1 AND CW#2 FROM CWSi
40
MOVE DESIGNATED NUMBER OF PIXELS FROM MPSA TO BUFFER (OR FIFO); (INCREMENT BUFFER ADDRESS ACCORDINGLY)
41
PROVIDE BACKGROUND TO BUFFER (FOR IVPC COUNT TO FIFO FOR IVPC LOCATIONS (AND INCREMENT BUFFER ADDRESS ACCORDINGLY
42
CONTINUATION BIT TRUE ?
NO
YES
43
GET NEXT CONTROL WORD #3 FROM CWSi
44
MOVE DESIGNATED NUMBER OF PIXELS FROM MPSA TO BUFFER (OR FIFO) (AND INCREMENT BUFFER ADDRESS ACCORDINGLY)
45
46
47
IS THERE CW#4 IN THIS CWSi ?
NO
YES
48
49
SET CWSi = CWSi + 1
50
51
52
ENTER NEXT CONTROL TABLE ADDRESS IN POINTER
53
EXIT OR RETURN

GRAPHICS DISPLAY SYSTEM WITH ARBITRARY OVERLAPPING VIEWPORTS

BACKGROUND OF THE INVENTION

1. Related Applications

This application is related to U.S. Pat. No. 4,533,910 entitled "Graphics Display System With Viewports Of Arbitrary Location And Content", which is assigned to Cadtrak Corporation, the assignee of the present application. The disclosure of U.S. Pat. No. 4,533,910 is incorporated herein by reference.

2. Field of the Invention

The present invention relates to a computer graphics display system in which individual viewports or images are produced on a video screen with arbitrary overlapping arrangement.

3. Description of the Prior Art

In the above-identified U.S. Pat. No. 4,533,910 there is a disclosed a system for producing a graphics display on a video screen containing viewports of arbitrary arrangement, number, size and content. An objective of the present invention is to provide an improvement of such system facilitating the production of a graphics display having overlapping viewports of arbitrary arrangement and graphics content.

In the above-identified graphics display system of U.S. Pat. No. 4,533,910 production of the graphics image is accomplished utilizing a control table comprising a set of control word sequences each consisting of one or more control words. Each sequence specifies the portion of a stored graphics image which is to be displayed in a corresponding segment of a viewport associated with that control word sequence. Appropriate controller circuitry accesses from a graphics image source memory the portion of pixel data specified by each control word sequence, and displays the accessed pixel data in accordance with certain display parameters (e.g., color, zoom factor, etc.) which may also be specified by the associated control word sequence.

A further objective of the present invention is to facilitate the production of graphic displays, utilizing such a control table system, but providing for arbitrary overlapping viewports through the utilization of one or more additional control words in each control word sequence associated with an overlapping viewport display.

A significant benefit achieved by utilizing such a system is that displays containing overlapping viewports can be generated rapidly, without the necessity for transferring large blocks of graphics data each time that a change in display content or viewport arrangemnt occurs. This time saving is particularly significant when the overlapping viewport is to be displayed only temporarily, and after its removal the hidden portions of the original viewport are to be reestablished.

In prior art systems, such situation required the following operations. Initially, when say a single viewport was being displayed, a digital representation of the entire display, including all pixel data representing the single viewport, was stored in a graphics image memory. The video display was produced by raster readout from that memory.

When the display was to be changed to include a second viewport overlapping a portion of the original viewport, the pixel data representing the hidden portion first had to be moved out of the graphics display memory into some other temporary storage location. The graphics image data representing the new, overlapping viewport then had to be written into the image memory. Thus the operation required two block transfer ("BIT-BLT") operations, namely, a removal of the "hidden" original image and an entry of the overlapping viewport data. Then when the overlapping viewport was removed, the "hidden" image portion of the original viewport had to be moved back into the graphics display memory by another bit-blt operation. Where large areas of the original hidden image were overlapped, such removal and replacement bit-blt operations were time consuming and demanded significant CPU overhead.

A further object of the present invention is to provide a graphics display system facilitating the introduction and removal of overlapping viewports of arbitrary size and location, without the need for bit-blt block transfers of the hidden image data at the times when the overlapping viewport is introduced and removed.

SUMMARY OF THE INVENTION

These and other objectives are achieved by providing a graphics display system in which the image to be displayed is established by a control table consisting of a set of control word sequences. Each sequence defines a portion of either a single viewport or portions of overlapping viewports. In the former instance, the control word sequence may consist of first and second control words that specify a source address from which image data for the viewport is to be obtained, viewport size and location information, and display parameters such as color and zoom factor. Advantageously, one of these first or second control words has a continuation bit or flag. For the overlapping viewport situation, that continuation or flag bit is "true", and the control word sequence also includes a third control word which specifies a source address for the image data contained in the portion of the overlapping viewport defined by that control word sequence.

Utilizing such an arrangement, the video display with arbitrary overlapping viewports may be generated in real time, utilizing the display system hardware disclosed in the above-identified U.S. Pat. No. 4,533,910. Alternatively, the present system may be used to enter into a graphics display memory an image containing arbitrary overlapping viewports, with the video display subsequently being produced by raster readout from this memory. In either embodiment, the invention is characterized by the use in each control word sequence of additional or continuation control words that specify the image information to be contained in the overlapping viewports.

BRIEF DESCRIPTION OF THE DRAWINGS

A detailed description of the invention will be made with reference to the accompanying drawings, wherein like numerals designate corresponding elements in the several figures.

FIG. 4 shows the formats of the control words included in each control word sequence of the control table illustrated in FIG. 3.

FIG. 5 is a pictorial view of a typical graphics display produced in accordance with the present invention and including different arrangements of overlapping viewports.

FIG. 6 illustrates control word sequences appropriate for producing the video display of FIG. 5

FIG. 7 is a pictorial representation of memory allotments in a graphics display system in accordance with the present invention.

FIG. 8 is a flow chart showing the steps involved with interpretation of the control word sequences, such as those of FIGS. 3 and 6, to produce displays, such as those of FIGS. 1, 2 and 5 in accordance with the present invention.

DESCRIPTION OF THE PREFERRED EMBODIMENT

The following description is of the best presently contemplated mode of carrying out the invention. This description is not to be taken in a limiting sense, but is made merely for the purpose of illustrating the general principles of the invention, since the scope of the invention best is defined by the appended claims.

Figure 1:
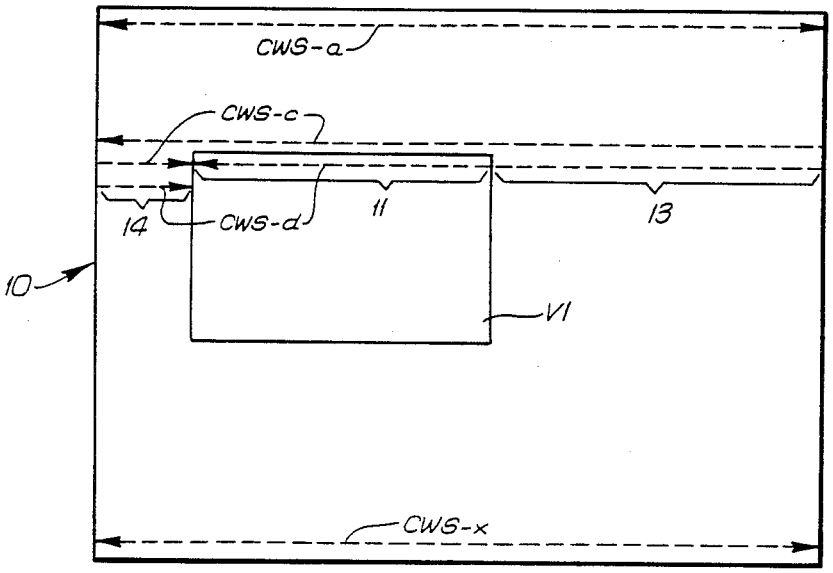
FIG. 1 is a pictorial view of a graphics display which may be produced on a video screen, and containing a single viewport.

FIG. 1 illustrates a typical display 10 which may be produced on a CRT or video screen using either the graphic display system of the present invention or that disclosed in the above-mentioned U.S. Pat. No. 4,533,910. In this display, there is a single viewport V1. The display 10, including the size, location and image content of the single viewport V1, is defined by the contents of a control table A containing a set of control word sequences such as that shown at the top of FIG. 3. The makeup and utilization of this control table A is similar to that described in connection with FIG. 3 of the above-mentioned U.S. Pat. No. 4,533,910.

In particular, the control table A contains a set of control word sequences CWS-a through CWS-x each associated with a portion of the display 10. In the example of FIG. 1 the control word sequence CWS-a is associated with the top horizontal row of the display 10, and is used only to designate the background color or shading of the display 10. The control word sequence CWS-c designates both the background color or shading for the horizontal row just above the viewport V1, and also designates the spacing (included in the "interviewport count") between the left edge or the display 10 and the left side of the viewport V1.

The next control word sequence CWS-d defines the contents of the top row 11 of the viewport V1. This sequence CWS-d (in control table A at the top of FIG. 3) advantageously contains two control words, the first of control word format #1 and the second of of format #2, which formats are shown in the top two rows of FIG. 4. The screen pixel count contained in control word #1 of the sequence CWS-d designates the width (i.e., number of image pixels) of the viewport segment 11. The memory pixel start address (MPSA) in control word #2 of the sequence CWS-d designates the starting address of a memory field containing graphics image data that is to be displayed within the viewport V1. FIG. 7 illustrates typical memory allocations in a memory 12. A region 12A of this memory contains graphics image data of one or more images (designated images (a), (b) and (c) in FIG. 7) which may selectively be displayed in one or more viewports of the display 10. The memory pixel start address (MPSA) designated in the control word #2 associated with a particular control word sequence will point to a certain start address in this graphics image data memory field 12A.

Referring again to FIGS. 1 and 3, the same control word sequence CWS-d also will specify, in the associated control word #1, the interviewport (IVPC) count or total number of screen pixels in the row segment 13 between the right edge of the viewport V1 and the right edge of the display 10, plus the number of screen pixels in the next line segment 14 between the left edge of the display 10 and the left edge of the viewport V1. Additional word control sequences (not shown) of makeup similar to the sequence CWS-d will be included within control table A to define the image content of each of the remaining rows of the viewport V1.

Figure 3:
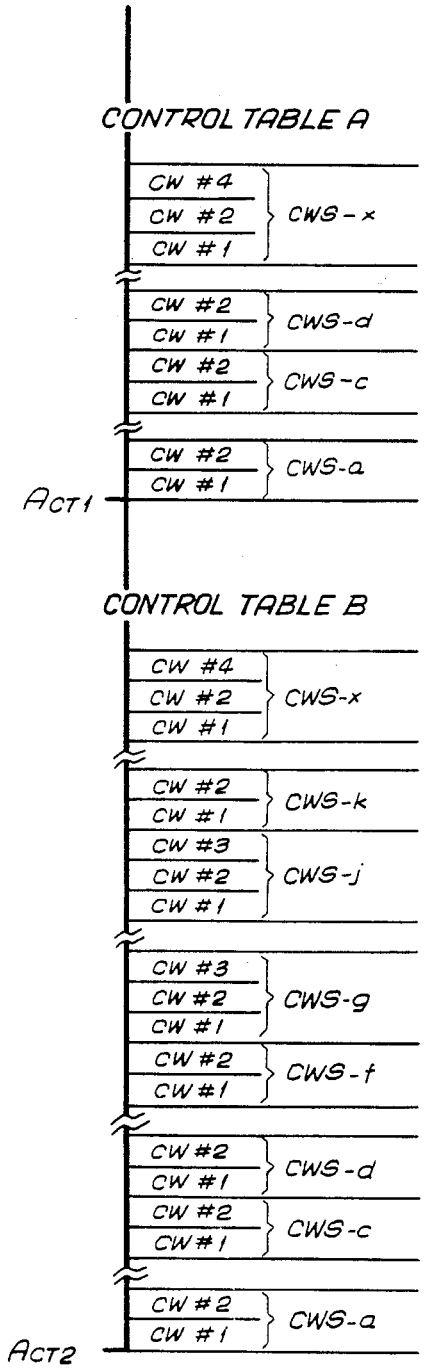
FIG. 3 is a pictorial representation of typical contents of a control table memory containing control word sequences appropriate for producing the displays of FIGS. 1 and 2.

This display region below the viewport V1 will be defined by another set of control word sequences designating no graphics information (i.e., with the content of the MPSA region of control word #2 empty). Finally, the bottommost row of the display 10 will be defined by a control word sequence CWS-x which also contains a control word of format #4 (as indicated at the top of FIG. 3 and by the control word format #4 at the bottom of FIG. 4). This final control word #4 will designate , by a true or "1" bit in the "end of frame" field, that the present control word sequence CWS-x designates the final row of the display 10.

The same control word #4 will contain, in the "control table address" field, the starting address of the control table which is to define the next graphics display frame that is to be produced. If the next frame is of the same makeup as the display 10, the contents of this control table address field will be the value $A_{CT1}$ designating the start address of the control table A (FIG. 3). All of the foregoing is substantially the same as set forth in the above-described U.S. Pat. No. 4,533,910.

Figure 2:
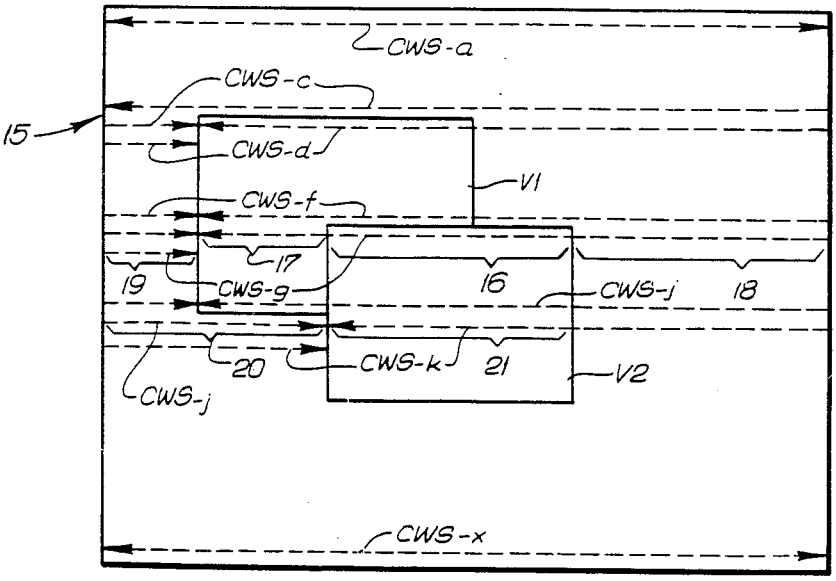
FIG. 2 is a pictorial view of a typical graphics display having overlapping viewports, produced in accordance with the present invention.

FIG. 2 shows a graphics display 15 including overlapping viewports produced in accordance with the present invention. Here a viewport V2 overlaps a portion of the viewport V1 which itself may have the graphics content and parameters of the corresponding viewport V1 in the display 10 of FIG. 1

The display 15 is produced using a control table B shown at the bottom of FIG. 3. In this control table B the control word sequences CWS-a through CWS-f correspond to the like control word sequences of control table A, and define the region of the display 15 from the top row down through the row just above the top of the overlapping viewport V2. Similarly, the region of the display 15 below the viewport V2 and down through the bottom row of the display are defined by a set of control word sequences like that for display 10, ending with a like sequence CWS-x.

To produce the portions of the display 15 containing the overlapped viewports, the corresponding control word sequences CWS-g through CWS-j contain control words of formats #1 and #2 that primarily concern the viewport V1 and also contain a third control word of format #3 (designated "CW#3" in FIG. 3) which primarily defines the overlapping viewport V2.

Thus in control table B the control word sequence CWS-g contains a control word #3 which contains in the screen pixel count field a designation of the width of the segment 16 of the viewport V2. The same control word #3 designates, in the memory pixel start address (MPSA) field, the starting address in the graphics image data memory 12A (FIG. 7) from which the graphics data for the viewport segment 16 is to be obtained. Typically, the image displayed in the viewport V2 will differ from that in the viewport V1. For example, the viewport V1 may contain a portion of the image (a) stored in the memory zone 12A (FIG. 7), while the contents of the overlapping V2 may be a portion of the different image (b) stored in the memory zone 12A. The control word #3 associated with the viewport V2 also may contain other display parameters for that viewport, such a pixel color base address or zoom factor.

The presence of a control word #3 in the sequence CWS-g is indicated in the continuation bit field of the control work #2 of that same sequence. This continuation or status bit will be true or "1".

In the same control word sequence CWS-g, the control words #1 and #2 specify the width (in the screen pixel count field) and the location of the graphics image data to be displayed, (in the MPSA field) in the segment 17 of the viewport V1 which is not hidden by the viewport V2. This width, and hence the screen pixel count contained in CW#1 of the sequence CWS-g, will of course be smaller than the overall width of the viewport V1. Accordingly, in assembling the graphics display 15, only the image data for the uncovered or non-hidden portions of the viewport V1 are transferred.

The interviewport count (IVPC) contained in control word #1 of the sequence CWS-g represents the total length of the row segment 18 between the right edge of the viewport V2 and the right edge of the display 15 plus the next row segment 19 between the left edge of the display 15 and the left edge of the viewport V1.

The control word sequence CWS-j associated with the bottom row of the viewport V1 and with a portion of the viewport V2 will be similar to the sequence CWS-g and will contain a continuation control word of format #3. The interviewport count (IVPC) in control word #1 in the sequence CWS-j will be greater than the IVPC value in CW#1 of the sequence CWS-g to account for the greater length of the row segment 20 between the left edge of the display 15 and the left edge of the viewport V2.

The next sequence CWS-k will only contain control words of format #1 and #2. In this instance, the content of these control words will define the content of the corresponding segment 21 of the viewport V2. Of course, the continuation or status bit field of the control word #2 in this sequence CWS-k will be false or "0", since no continuation control word #3 is used as there is no overlapping viewport portion associated with the row defined by the sequence CWS-k.

The final control word sequence CWS-x associated with the display 15 will contain a control word of format #4. This will indicate by a true or "1" bit in the end of frame field that this is the last row of the display. The control table address contained in this control word #4 will indicate which control table is to be used to generate the next frame. If the same display 15 with overlapping viewports V1 and V2 is to be repeated, this control table address field of the word CW#4 in the sequence CWS-x will contain the value $A_{CT2}$ associated with control table B (FIG. 3). On the other hand, if it is desired to remove the overlapping viewport V2 and once again produce the display 10 with only the single viewport V1, then the control table address of the word CW#4 in the sequence CWS-x will contain the address $A_{CT1}$ associated with control table A. On the next frame, that control table A will be used to produce the display 10. The change in display will require no bit-blt block transfer return of the hidden graphics image data in the viewport V1, as was required in the prior art.

The present invention is not limited to the arrangement of FIG. 2 where one viewport V2 overlaps a portion of another viewport V1. Indeed, the number and arrangement of overlapping viewports is completely arbitrary. Two other examples of overlapping viewport arrangements are illustrated in FIG. 5. There, the display 25 includes a set of three overlapping viewports V3, V4, V5. The control word sequences, such as the sequence CWS-t, which encompass all three of the overlapping viewports V3–V5 will contain two continuation words of format #3.

This is illustrated by the sequence CWS-t of FIG. 6. In that sequence, the control words CW#1 and CW#2 will specify the width and graphics content of the segment 26 associated with the viewport V3. This control word CW#2 will have a true or "1" continuation bit. The next control word CW#3 in the sequence CWS-t will be of format #3 and will specify the width and source address (MPSA) of the graphics content of the segment 27 of the central viewport V4. This first control word #3 itself will have a true or "1" bit in the continuation bit field, indicating that there is yet another continuation word CW#3 of format #3 within the sequence CWS-t. That final control word #3 itself will define the width and source address (MPSA) for the graphics content of the segment 28 within the viewport V5. The continuation bit field of this final control word #3 will be false or "0", indicating that there are no additional control words of format #3 in this control word sequence CWS-t.

The display 25 of FIG. 5 contains yet another example of overlapping viewports that may be produced using the present invention. In this case, a first viewport V6 is overlapped in part by a smaller viewport V7 situated completely "within" the first viewport V6. This arrangement is generated using control word sequences such as the sequence CWS-w of FIG. 6.

This sequence CWS-w also contains two continuation control words CW#3. In particular, the first two control words CW#1 and CW#2 of the control word sequence CWS-w define a width and source address (MPSA) for the graphics content of the segment 29 of the viewport V6 to the left of the overlapping viewport V7. The continuation bit of this control word CW#2 will be true or "1", indicating the presence of at least one continuation word of format #3 in the sequence CWS-t. That first control word #3 itself will designate the width and source address of the graphics data for the segment 30 in the overlapping viewport V7. This first control CW#3 also will have a true "1" continuation bit, indicating the presence of another continuation word CW#3 in the sequence CWS-t. That word CW#3 itself will specify the width and source address (MPSA) of the image data for the segment 31 of the viewport V6 situated to the right of the overlapping viewport V7. The continuation bit of this final control word #3 itself will be false or "0", indicating that there are no additional control words of format #3 in the sequence CWS-t The various control tables A, B and C described hereinabove, can be utilized directly in the hardware real time display system disclosed in the above-identified U.S. Pat. No. 4,533,910. In that copending application, the control word of format #3 was used in connection with toroidal panning of the image displayed within a single viewport. The present invention utilizes the continuation control words of format #3 for the different purpose of producing overlapping viewports of arbitrary arrangement and graphics content. Use of the system implementation shown e.g., in FIG. 2 of the U.S. Pat. No. 4,533,910 permits real time direct generation of video displays containing overlapping viewports, when used with the continuation control word arrangement disclosed in the present application.

Alternatively, the present invention can be used in connection with a system in which the image produced on a video screen or CRT is generated by storing the entire image, in digital format, in an image memory. That memory is read out, in raster fashion, in synchronism with the CRT scanning, and the output converted from digital to analog format to produce the video drive signals for the CRT. Often such systems include two separate image memories or buffers, with the CRT being driven alternately from one of the two image buffers, while the other is being rewritten with new display information. Such double-buffered image memory arrangement is employed in many present day personal computers and other graphics display systems.

The inventive continuation control word system disclosed herein for the production of overlapping viewport displays readily can be used with such personal computer or video display system having an image buffer memory. In such implementation, a control word interpreter program, such as that shown in block diagram form in FIG. 8, may be employed to generate in the image buffer a display with overlapping viewports defined by a control table of the type disclosed herein.

The control table interpreter program 35 (FIG. 8) is entered at the beginning of formation of the display image. In a real time system, this may be synchronized with the beginning of a new frame. Initially (block 36) a pointer is set to the initial address of the selected control word table. The pointer may comprise a register which initially is loaded with the address $A_{CT1}$ or $A_{CT2}$ or $A_{CT3}$ corresponding respectively to the starting address of control tables A, B and C described above. Also (block 37) a control word sequence counter is initialized to point to the first control word sequence (e.g., the sequence CWS-a) in the selected control table.

If the interpreter 35 is being used to load a graphics memory, the address pointer of this image buffer is initialized (block 38) e.g., to point initially to the top left corner of the display. If the interpreter 35 is being used with a real time system, or with the first-in, first-out (FIFO) system disclosed in the U.S. Pat. No. 4,533,910 the operation block 38 is skipped.

Next (block 39) the first two control words CW#1 and CW#2 are obtained from the control word sequence $CWS_i$ in the designated control table. Using the contents of the screen pixel count, word count and memory pixel start address fields of these control words CW#1 and CW#2, the designated number of image pixels are moved from the image source (such as the graphics image data zone 12A of FIG. 7) into the designated image buffer locations. In the event that a graphics display parameter such as zoom is indicated by the contents of the words CW#1 or CW#2, appropriate modification may be made of the pixel data before it is entered into the buffer. For example, if zoom is employed, pixel replication may be used prior to image data entry into the image buffer. In real time embodiments, or in the FIFO embodiment of U.S. Pat. No. 4,533,910, the designated image pixels may be supplied (at block 40) directly to the FIFO or directly to the graphics display device, along with the parameter information.

Next (block 41), the interviewport count from the IVPC field of control word #1 is used to direct the supply of background pixels to the buffer or FIFO. The buffer address is incremented accordingly.

A check is then made (at block 42) to determine if the control word #2 contains a true or "1" continuation bit. If it does, indicating the presence in the control word sequence $CWS_i$ of at least one continuation control word of format #3, this CW#3 is accessed from the appropriate control table (block 43). The graphics data designated by that control word #3 (which typically defines the graphics content of a row portion of an overlapping viewport such as the viewport V2 of FIG. 2) is accessed from the designated MPSA address in the graphics image data memory zone 12A and moved to the buffer or FIFO (block 44).

The interpreter 35 then loops back (via the path 45 to the block 42) to determine if the continuation bit of the present control word #3 is true or "1". If it is, another control word #3 is present in the control word sequence. This would be the situation with the sequence CWS-t or CWS-w of FIG. 6. In this event, the blocks 43 and 44 are executed once again so as to provide the graphics data for the corresponding overlapping viewport segments to the image buffer or FIFO.

If the continuation bit is false or "1", the block 42 is exited is via the path 46 and a determination is made (block 47) as to whether there is a control word #4 in the present control word sequence $CWS_i$. If the present control word sequence is not the final one in the control table being used, the block 47 will be exited via a path 48 and the control word sequence counter will be incremented to point to the next sequence in the control table being used. The interpreter program then will loop back via the path 50 to the block 39 and repeat the steps just described.

If the final control word sequence is being processed (i.e., there is a CW#4 in the present control word sequence), the block 47 will be exited via a path 51. The control table address next to be used then is obtained from the control word #4 and entered into the control table pointer register (block 52). If a single control table is used to generate the entire display, this will be the final operation, and the program is exited at 53. Alternatively, two or more control tables may be used to generate different portions of the display image. In that event, the control word sequence counter would again be initialized (e.g., set to CWS-a for the new control table), and the program would return to block 39.

The instruction set for the control table interpreter 35 may itself be stored in a zone 12B (FIG. 7) of the memory 12. That memory may also store the control tables in a zone 12C. A control table assembler program, used for establishing the contents of the control tables, also may be stored in a zone 12D. Such an assembler is generally described in the above-identified U.S. Pat. No. 4,533,910. In a display system using image buffers from which the CRT display is generated by raster readout, zones 12E and 12F of the memory 12 may be utilized as such image buffers.

Thus the present invention provides an efficient system for producing graphics displays with arbitrary overlapping viewports. The arrangement of the viewports can simply be changed by altering the contents of the control table. An overlapping viewport may be readily introduced and removed merely by changing the contents of the control table, or alternately by selecting different prestored control tables. For example, the control table B or FIG. 3 may specify graphics contents for the non-hidden region of the viewport V1 corresponding to identical graphics information in the single viewport V1 of FIG. 10. In that case, the overlapping viewport V2 of FIG. 2 can be "introduced" and "removed" from the display merely by switching between control tables A and B. No block transfer of image data is required at the time the transition is made from the display 10 to the display 15 or from the display 15 to the display 10. In this manner, the introduction and removal of overlapping viewports is very efficiently implemented.

I claim:

1. A control system for generating a video displayable graphics image in which pixel data representing said image is stored in a memory and is assembled in accordance with a control table also stored in said memory, the improvement wherein:

said control table utilizes a set of control word sequences, each sequence including a first control word or words specifying the portion of said stored pixel data which is to be displayed in a segment of a single viewport and at least one continuation control word specifying the portion of said stored pixel data which is to be displayed in a segment of a separate viewport which overlaps a portion of said single viewport, and wherein:

said system includes means for utilizing the contents of said first control word or words and the contents of said at least one continuation control word to assemble a graphics image having overlapping viewports in which said segments of said single viewport and said separate viewport have no interviewport spacing between them.

2. A control system for generating a video displayable graphics image in which pixel data representing said image is stored in a memory and is assembled in accordance with a stored control table, comprising:

first means for utilizing in said control table a set of control word sequences, at least one of said sequences including a first control word or words specifying the portion of said stored pixel data which is to be displayed in a segment of a single viewport and at least one continuation control word defining the graphic contents of a segment of a separate but overlapping viewport, said first control word or words including a continuation field the contents of which indicates the presence in the corresponding sequence of said at least one continuation control word, and second means, responsive to the contents of said continuation field, for reading out pixel data and constructing said graphics image for said overlapping viewport based on the contents of said at least one continuation control word.

3. A control system for generating a graphics image displayable on a video display, and in which said displayable image is stored in the form of pixel data in a memory and is assembled by acquiring pixel data from said memory for video scan line portions of said image defined by a set of sequential control word sequences contained in a first control table, the improvement wherein:

each control word sequence in said first control table includes at least one first control word defining a video scan line portion of a single viewport and including a continuation field, at least some of said control word sequences including at least one continuation control word defining a video scan line portion of another overlapping independent viewport, said system including:

first means responsive to said at least one first control word for acquiring pixel data specified therein and providing the same for use in said displayable image, and second means, actuated in response to the contents of said continuation field, for acquiring pixel data specified in said continuation control word and providing the same for use in said displayable image, wherein overlapping viewports are established.

4. A control system according to claim 3 having a second control table containing another set of sequential control word sequences defining a displayable image having a non-overlapped viewport containing image graphics data corresponding to the image graphics data of said single viewport, said system further including:

means for alternately selecting whether said first control table or said second control table is used for generating said displayable image, wherein said displayable image will contain said single viewport by itself, or said single viewport overlapped in part by said other independent viewport, in accordance respectively with whether said second or said first control table is selected.

5. A graphics display control system for generating a graphics image displayable on a video display, comprising:

a pixel memory for storing pixel data representing said graphics image;

means for storing a control table in said pixel memory, consisting of a set of control word sequences, each sequence including a first control word subsequence containing one or more control words and specifying a segment of a single viewport, said specification including a first address identification in said pixel memory of the location of the pixel data for said single viewport segment, and information relating to the position of said segment within said displayable image, selectable ones of said control word sequences also containing a second control word subsequence containing one or more control words and specifying a segment of another viewport intended to overlap at least a portion of said first viewport, said specification including a second address identification in said pixel memory of the location of the pixel data for said overlapping second viewport segment, control table interpreter means, cooperating with said means for storing and responding sequentially to said set of control word sequences, for acquiring the pixel data for the segment of said single viewport specified by said first control word subsequence from said first identified address in said pixel memory and for supplying that data to generate said displayable image, and means, responsive to the presence of said first control word subsequence, for acquiring the pixel data for the segment of said overlapping second viewport specified by said second control word subsequence from said second identified address in said pixel memory and supplying that data to generate said displayable image, wherein a displayable graphics image containing overlapping viewports is produced.

* * * * *